US006018120A

United States Patent [19]

Steinberger

[11] Patent Number: 6,018,120

[45] Date of Patent: Jan. 25, 2000

[54] ACOUSTIC MUSICAL INSTRUMENT OF THE VIOLIN FAMILY WITH PIEZO-ELECTRIC PICKUP

[76] Inventor: Richard Ned Steinberger, HC 64 Box 090B, Walpole, Me. 04573

[21] Appl. No.: 08/888,617

[22] Filed: Jul. 7, 1997

[51] Int. Cl.[7] ..... G10D 1/02; G10H 3/18

[52] U.S. Cl. ..... 84/731; 84/276; 84/277; 84/DIG. 24

[58] Field of Search ..... 84/731, 274–277, 84/DIG. 24, 291, 292

[56] References Cited

U.S. PATENT DOCUMENTS 4,491,051 1/1985 Barcus ..... 84/DIG. 24
4,727,634 3/1988 Fishman ..... 84/DIG. 24
4,843,937 7/1989 Murphy ..... 84/DIG. 24
5,537,906 7/1996 Steinberger ..... 84/291

*Primary Examiner*—Stanley J. Witkowski
*Attorney, Agent, or Firm*—Saul Epstein

[57] ABSTRACT

A musical instrument of the violin family which has a piezo-electric pickup installed under the foot of the bridge which is supported by the bass bar. The forces generated in the bridge by the vibrating strings are transmitted through the pickup to the top of the instrument. The pickup is comprised of a sandwich including a small piezo-electric sensor covered by conductive foils on the outside which serve as the ground of the pickup and an electrostatic shield.

4 Claims, 2 Drawing Sheets

ACOUSTIC MUSICAL INSTRUMENT OF THE VIOLIN FAMILY WITH PIEZO-ELECTRIC PICKUP

BACKGROUND OF THE INVENTION

Acoustic musical instruments of the violin family, i.e., the violin, viola, cello, and double bass, generate a relatively small amount of acoustic power, and electronic amplification is often desirable. This invention is intended to facilitate such amplification.

Among the objects of the present invention are to provide an electric pickup for an acoustic instrument of the violin family that:

1. produces the full range of sound, both bowed and plucked;
2. has a high output level before amplification;
3. is relatively immune to acoustic feedback
4. is convenient to install;
5. does not require modification of the original instrument;
6. does not impair the acoustic properties of the original instrument; and
7. is economical to produce.

Other objects and advantages of the invention will become apparent to those skilled in the art from a reading of the following specification.

SUMMARY OF THE INVENTION

This invention involves a stringed musical instrument wherein one or more piezo-electric crystal sensing elements are placed under one of the feet of the bridge. In particular the invention is applicable to acoustic instruments of the violin family, e.g., violin, viola, cello, and double bass, which instruments include (within the body) a sound post located under one foot of the bridge and a relatively stiff bass bar under the other foot. The sound post couples the string induced vibrations of the bridge to the back of the instrument, while the bass bar runs longitudinally through the instrument and stabilizes the top under the bass string side of the bridge. Even though the bass bar is relatively stiff, vibrations are nevertheless induced in the top by forces coupled from the strings to the top through the bass string side foot.

The sensing element(s) of the present invention are placed between the bridge and the instrument top, preferably under the foot of the bridge which is supported by the bass bar. The pickup forms a part of the coupling of vibrations from the strings to the top of the instrument; hence the forces which cause the top to vibrate are transmitted through and are developed across the pickup. This leads to a very clear and natural sound. It has been found that a bass side location of the pickup results in an electronically amplified sound which more closely replicates the acoustic sound of the instrument than does a location under the treble side of the bridge.

DETAILED DESCRIPTION OF THE INVENTION

Figure 1:
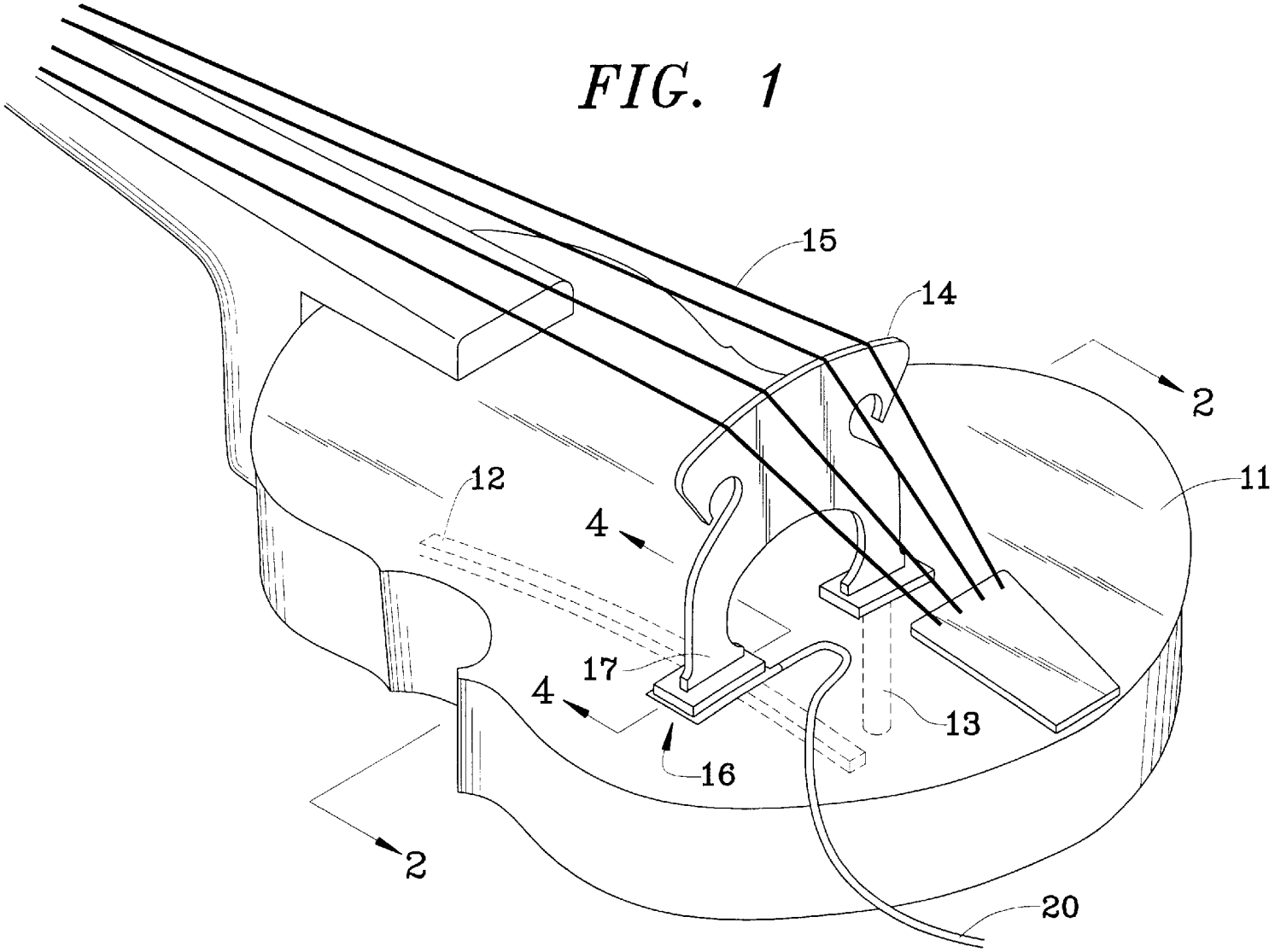
FIG. 1 is a perspective view of the body of a musical instrument which includes the present invention.
Figure 2:
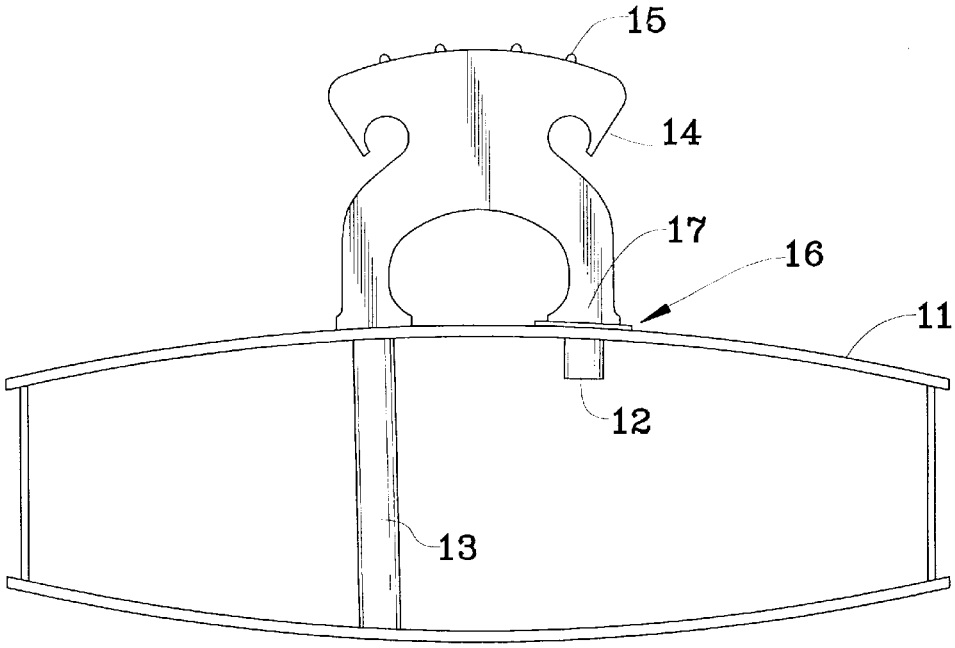
FIG. 2 is a fragmentary cross sectional view of the musical instrument of FIG. 1, taken at 2—2 of FIG. 1.

A portion of a musical instrument of the violin family is shown in FIG. 1, which instrument incorporates the present invention and includes a top 11, a bass bar 12, a sound post 13, a bridge 14, and strings 15 having different resonant frequencies. The strings having the lowest resonant frequencies are called the bass strings. A piezo-electric pickup 16 is located between the foot 17 of bridge 14 and top 11. The pickup 16 is preferably located under the foot of the bridge which is supported by the bass bar, i.e., under the side of the bridge nearest the bass strings. Tension in the strings forces the bridge against the instrument top, resulting in good contact between the pickup and the bridge. Hence, vibrations of the strings are coupled directly to the pickup, and high output is obtained. Since the bass bar is relatively stiff, it, as well as the top, form a base against which the force which drives the pickup is developed.

Figure 3:
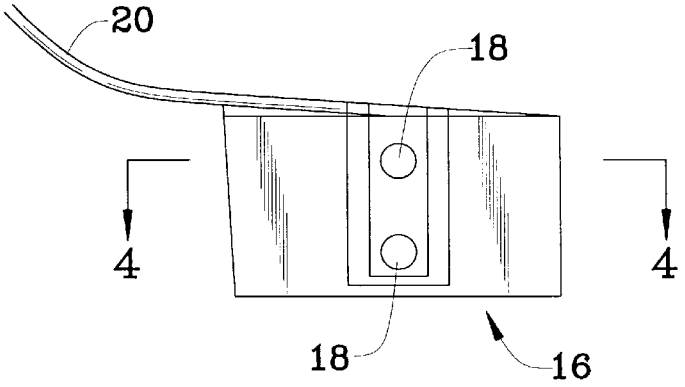
FIG. 3 is a plan view of one embodiment of a pickup according to the present invention; said embodiment including two sensing elements.

The pickup 16 may include one or more sensing elements 18; the pickup shown in FIG. 3 including two. Generally, the smaller instruments, such as the violin and viola will use one sensor, while the larger cello and double bass may use two.

Figure 4:
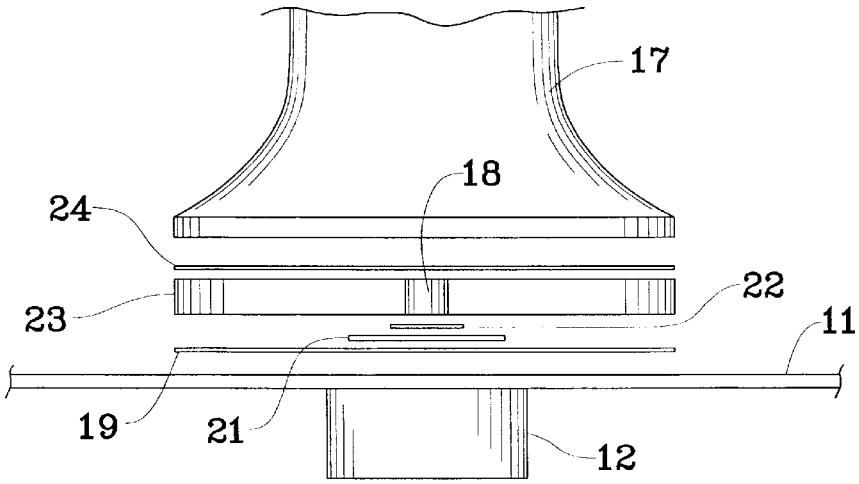
FIG. 4 is a cross sectional view of the pickup of FIG. 3 taken at 4—4 of FIGS. 1 and 3. The pickup is shown exploded in the vertical direction for clarity. Portions of the instrument top and the bridge are also shown.

As can be seen in FIG. 4, the pickup is a sandwich of several elements. The bottom layer, which rests against the instrument top, is a piece of conductive foil 19 which acts as an electrical shield. It is connected to the shield/ground of the shielded output lead 20. An insulating pad 21 insulates foil 19 from the "hot" foil connector 22, which foil rests against one side of the sensor(s) 18. Foil connector 22 makes the "hot" connection to the sensor(s). Foil 22 is connected to the center conductor of of output lead 20, which conducts the output signal to an amplifier (not shown). The area of the pickup surrounding the sensor(s) 18 is filled with a soft insulating material, such as double sided foam tape 23. The tape 23 holds the pickup together before it is installed on an instrument, but being soft, does not appreciably affect the pressure of the bridge foot on the sensor(s). The sensor ground connection is made by foil sheet 24, which is located between the bridge foot 17 and sensor(s) 18. Foil sheet 24 is connected to the ground/shield of output lead wire 20. Conductive foil sheets 19 and 24 effectively shield the pickup from extraneous electric fields.

With the construction shown, the pressure of the bridge is concentrated on the sensing element(s) located under the bridge foot. Preferably, the pickup is situated between the bridge foot which is over the instrument's bass bar (which is a relatively stiff member) and the top of the instrument. This results in a strong signal, with a high signal to noise ratio, and a minimum of extraneous sound, such as bow noise. The bass bar location also contributes to a reduced difficulty from acoustic feedback. While the bass bar is relatively stiff, it does not prevent the top from being vibrated by the forces transmitted through sensor(s) 18 from the bass string side bridge foot.

Since piezo-electric sensing elements can be made quite small (3/16 in. diameter×1/32 in thick being readily available) a pickup as described above can easily be installed on an existing violin, or other instrument of the violin family, without modification of the instrument. Also since the sensing element(s) can be small as indicated in the previous sentence, a pickup can be made according to the construction described which is flexible and can be made to conform to the curved shape of the top of the instrument. It has been found that installation of such a pickup does not impair the acoustic properties of the instrument.

I claim:

1. In an acoustic musical instrument of the violin family, which includes a body having a top, a plurality of strings having different resonant frequencies, a bridge supporting said strings, said bridge having feet which are pressed against said top by tension in said strings and causing said top to vibrate in accordance with vibrations of said strings, and a bass bar supporting said top under the foot of said bridge closest to the bass strings, the improvement which comprises:

a pickup comprising one or more piezo-electric sensing element(s), said pickup being located between the foot of said bridge closest to said bass strings and said vibrating top.

2. In an acoustic musical instrument of the violin family as recited in claim 1 wherein substantially all of the force exerted by said base side foot is transmitted to said vibrating top through said piezo-electric sensing element(s).

3. In an acoustic musical instrument of the violin family as recited in claim 1 wherein said piezo-electric sensing element(s) are encased in a foil sandwich which provides shielding from external electric fields.

4. In an acoustic musical instrument of the violin family as recited in claim 3 wherein said pickup is flexible and is conformable to the shape of said top.

* * * * *